US005579958A

United States Patent [19]

Su

[11] Patent Number: 5,579,958

[45] Date of Patent: Dec. 3, 1996

[54] LIQUID SPRAYER

[76] Inventor: Cheng-Yuan Su, P.O. Box 438, Hsinchu City, Taiwan

[21] Appl. No.: 542,018

[22] Filed: Oct. 12, 1995

[51] Int. Cl.[6] ..... B67D 5/42

[52] U.S. Cl. ..... 222/321.2; 222/321.7

[58] Field of Search ..... 222/321.2, 321.7, 222/321.8, 321.9, 382, 383.1, 385; 239/333

[56] References Cited

U.S. PATENT DOCUMENTS

| | | | |
|---|---|---|---|
| 3,908,870 | 9/1975 | Nozawa et al. | 222/321.2 |
| 4,025,046 | 5/1977 | Boris | 222/321.2 |
| 4,277,001 | 7/1981 | Nozawa | 222/321.4 |
| 4,305,530 | 12/1981 | Nozawa | 222/385 |
| 4,369,900 | 1/1983 | Saito et al. | 222/321.2 |
| 4,462,549 | 7/1984 | Saito et al. | 239/333 |
| 4,606,479 | 8/1986 | Van Brocklin | 239/333 |
| 4,821,928 | 4/1989 | Su | 239/333 |
| 4,930,999 | 6/1990 | Brunet et al. | 417/552 |
| 5,002,228 | 3/1991 | Su | 222/321.2 |
| 5,370,280 | 12/1994 | Su | 222/385 |

FOREIGN PATENT DOCUMENTS

| | | |
|---|---|---|
| 2314772 | 1/1977 | France . |
| 2512517 | 3/1983 | France . |
| 2004585 | 4/1979 | United Kingdom . |

*Primary Examiner*—Andres Kashnikow
*Assistant Examiner*—Philippe Derakshani
*Attorney, Agent, or Firm*—Bacon & Thomas

[57] ABSTRACT

A liquid sprayer including a movable inductor valve core supported on a spring in a cylinder inside the container thereof for controlling accumulation of pressure, the movable inductor valve having two vertically spaced horn-like flanges around the periphery, which move downwards to seal the small bottom chamber of the cylinder from the big upper chamber thereof, for permitting a liquid to be forced out of the nozzle of the press head of the liquid sprayer when the press head is depressed.

1 Claim, 2 Drawing Sheets

LIQUID SPRAYER

BACKGROUND OF THE INVENTION

The present invention relates to liquid sprayers, and relates more particularly to the movable inductor valve core of a liquid sprayer.

Regular liquid sprayers are generally comprised of a container which holds a liquid, a cylinder suspended in the container, a dip tube connected to the cylinder and suspended in the container for drawing the liquid from the container into the cylinder, a press head movably supported on the container and having a downward tubular plunger coupled with a hollow piston and moved in the cylinder. When the press head is depressed, the hollow piston is moved downwards to force the liquid from the cylinder out of a nozzle on the press head. However, this structure of liquid sprayer is still not satisfactory in function because the hollow piston is not closely contact the inside wall of the cylinder during its down stroke and a less pressure is produced for efficiently forcing the liquid from the cylinder out of the nozzle of the press head.

SUMMARY OF THE INVENTION

The present invention has been accomplished to provide a liquid sprayer which eliminates the aforesaid drawback. It is one object of the present invention to provide a movable inductor valve core for a liquid sprayer which greatly improves the performance of the liquid sprayer for permitting the liquid to be efficiently squeezed out of the nozzle upon each down stroke of the press head of the liquid sprayer. It is another object of the present invention to provide a movable inductor valve core for a liquid sprayer which effectively seals the cylinder to accumulate pressure when it is moved downwards. According to the preferred embodiment of the present invention, the movable inductor valve core mounted inside the cylinder inside the container of the liquid sprayer an supported on a spring for controlling passage between the small bottom chamber of the cylinder and the big upper chamber thereof. The movable inductor valve core comprises a front rod section terminating in a conical tip for blocking up the valve block, a rear rod section, an intermediate rod section connected between the front rod section and the rear rod section, a first horn-like flange disposed around the connecting area between the front rod section and the intermediate rod section, and a second horn-like flange disposed around the connecting area between the rear rod section and the intermediate rod section, each of the horn-like flanges defining a respective inwardly sloping groove at a top end around the front rod section and the intermediate rod section respectively.

DETAILED DESCRIPTION OF THE PREFERRED EMBODIMENT

Figure 1:
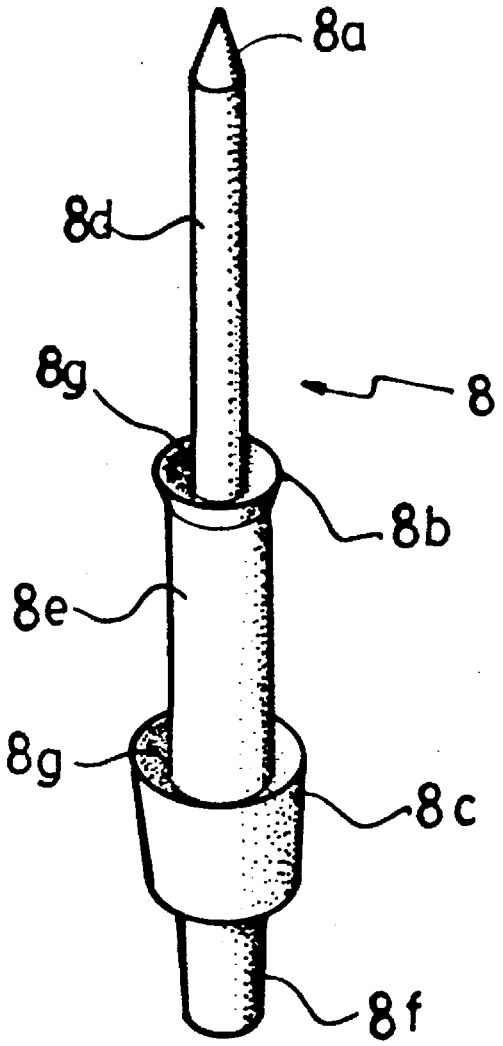
FIG. 1 is an elevational view of a movable inductor valve core according to the present invention.

Referring to FIG. 1, the movable inductor valve core, referenced by 8, comprises a front rod section 8*d* terminating in a conical tip 8*a*, a rear rod section 8*f*, an intermediate rod section 8*e* connected between the front rod section 8*d* and the rear rod section 8*f*, a first horn-like flange 8*b* disposed around the connection between the front rod section 8*d* and the intermediate rod section 8*e*, and a second horn-like flange 8*c* disposed around the connection between the rear rod section 8*f* and the intermediate rod section 8*e*. Each of the horn-like flanges 8*b* and 8*c* defines a respective inwardly sloping groove 8*g* around the front rod section 8*d* or the intermediate rod section 8*e*.

Figure 2:
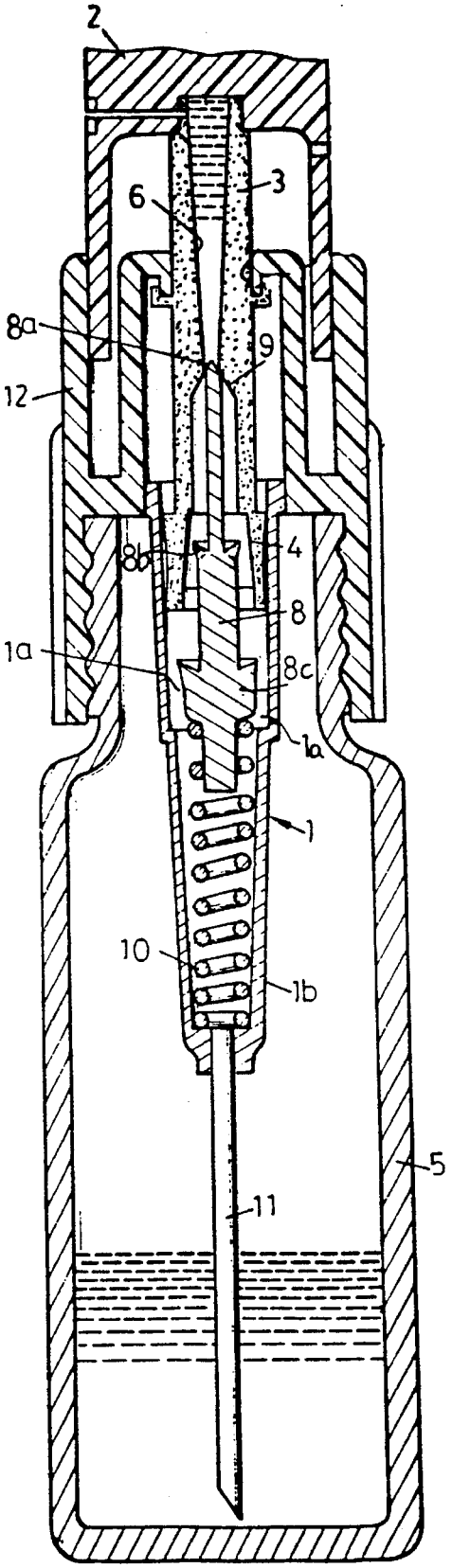
FIG. 2 is an installed view showing the movable inductor valve core installed in the cylinder of a liquid sprayer according to the present invention.

Referring to FIG. 2, the aforesaid movable inductor valve core 8 is mounted in the inside cylinder 1 of the sprayer and supported on a spring 10. When the press head 2 of the sprayer is not depressed, the movable inductor valve core 8 is forced upwards by the spring 10 with the tip 8*a* stopped at the valve block, referenced by 9. At this stage, the big upper chamber 1*a* of the cylinder 1 and the small bottom chamber 1*b* thereof are disposed in communication with each other; the inside space of the cylinder 1 communicates with that of the container, referenced by 5, through the dip tube, referenced by 11; liquid is induced from the container 5 into the big upper chamber 1*a* and the small bottom chamber 1*b* through the dip tube 11; the inside space of the cylinder 1 is separated from that of the press head 2.

Figure 3:
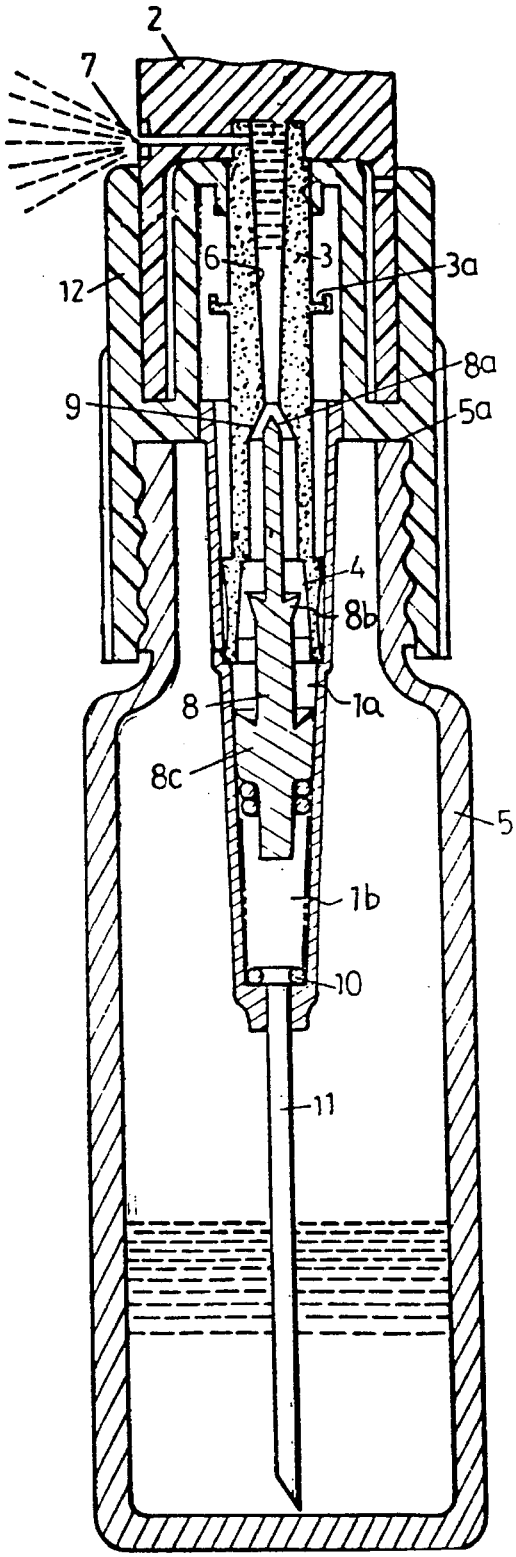
Fig. 3 is similar to FIG. 2 but showing the liquid forced out of the nozzle of the press head.

Referring to FIG. 3, when the press head 2 is depressed to lower the plunger 3 and the hollow piston 4, the valve block 9 which is mounted on the plunger 3 is simultaneously moved to force down the movable inductor valve core 8, causing the second horn-like flange 8*c* to stop against the tapered inside wall of the small bottom chamber 1*a* and to separate the small bottom chamber 1*b* from the big upper chamber 1*a*. When the piston 4 is continuously moved downwards, the space inside the hollow piston 4 above the second horn-like flange 8*c* is relatively reduced, and the pressure is relatively increased and downwardly acted onto the inwardly sloping grooves 8*g*. As soon as the downward pressure surpasses the spring force of the spring 10, the movable inductor valve core 8 is forced downwards to disengage the tip 8*a* from the valve block 9, for permitting liquid to be forced out of the spray nozzle 7 of the press head 2 through a liquid passage 6. When the press head 2 is released, the spring 10 pushes the movable inductor valve core 8, the plunger 3, and the press head 2 upwardly back to their former positions, and therefore the tip 8*a* of the movable inductor valve core 8 is forced into engagement with the valve block 9 again. When the second horn-like flange 8*c* is moved upwards and disengaged from the tapered inside wall of the small bottom chamber 1*b* during the return stroke of the movable inductor valve core 8, a suction force is induced to draw liquid from the container 5 into the small bottom chamber 1*b* and the big upper chamber 1*b* through the dip tube 11.

As indicated, the movable inductor valve core 8 has horn-like flanges 8*b* and 8*c* which effectively seal the small bottom chamber 1*b* from the big upper chamber 1*a* for accumulation of pressure so that liquid can be efficiently forced out of the press head 2 through the nozzle 7.

I claim:

1. A liquid sprayer comprising a container which holds a liquid, a cylinder suspended in said container and defining a big upper chamber and a small bottom chamber, a press head movably supported on said container and depressed to force said liquid out of a nozzle thereof, a plunger downwardly extended from said press head, a valve block connected to said plunger and defining with said plunger a liquid passage communicating between said big upper chamber and said nozzle, a hollow piston connected to said valve block remote from said plunger, a spring mounted inside said small bottom chamber, a dip tube connected to said cylinder for drawing said liquid from said container into said cylinder, and a movable inductor valve core mounted inside said cylinder and supported on said spring for controlling passage between said small bottom chamber and said big upper chamber, wherein said movable inductor valve core comprises a front rod section terminating in a conical tip for blocking up said valve block, a rear rod section, an intermediate rod section connected between said front rod section and said rear rod section, a first horn-like flange disposed around the connecting area between said front rod section and said intermediate rod section, and a second horn-like flange disposed around the connecting area between said rear rod section and said intermediate rod section, each of said horn-like flanges defining a respective inwardly sloping groove at a top end around said front rod section and said intermediate rod section respectively.

* * * * *